US009686620B2

(12) United States Patent
Hannemann et al.

(10) Patent No.: US 9,686,620 B2
(45) Date of Patent: Jun. 20, 2017

(54) METHOD OF ADJUSTING A HEARING APPARATUS WITH THE AID OF THE SENSORY MEMORY

(71) Applicant: SIVANTOS PTE. LTD., Singapore (SG)

(72) Inventors: Ronny Hannemann, Buckenhof (DE); Maja Serman, Erlangen-Buckenhof (DE)

(73) Assignee: Sivantos Pte. Ltd., Singapore (SG)

( * ) Notice: Subject to any disclaimer, the term of this patent is extended or adjusted under 35 U.S.C. 154(b) by 612 days.

(21) Appl. No.: 13/783,612

(22) Filed: Mar. 4, 2013

(65) Prior Publication Data

US 2013/0230182 A1 Sep. 5, 2013

(30) Foreign Application Priority Data

Mar. 2, 2012 (DE) ..... 10 2012 203 349

(51) Int. Cl.
*H04R 25/00* (2006.01)

(52) U.S. Cl.
CPC ..... *H04R 25/30* (2013.01); *H04R 25/70* (2013.01); *H04R 25/552* (2013.01); *H04R 2225/81* (2013.01); *H04S 2420/01* (2013.01)

(58) Field of Classification Search
CPC ..... A61B 5/121; A61B 5/12; A61B 5/123; A61B 5/125; A61B 5/04845; A61B 5/6815; A61B 5/6817; A61B 5/6887; H04R 25/70; H04R 25/30; H04R 25/552; H04R 25/558; H04R 1/1091; H04R 2225/41; H04R 2430/20; H04R 25/40; H04R 25/407; H04R 2225/81; H04S 2420/01
USPC ..... 381/60, 313; 600/559
See application file for complete search history.

(56) References Cited

U.S. PATENT DOCUMENTS 5,825,894 A * 10/1998 Shennib ..... 381/60
6,916,291 B2 * 7/2005 Givens et al. ..... 600/559
2010/0196861 A1 8/2010 Lunner

FOREIGN PATENT DOCUMENTS

DE 102009032238 A1 7/2010
EP 2380171 10/2011
WO 2010/078938 A2 7/2010

OTHER PUBLICATIONS

Sensory memory http://en.wikipedia.org/wiki/Sensory_memory.
Lunner, "Cognitive function in relation to hearing aid use", International Journal of Audiology, Oticon A/S, Research Centre Eriksholm, Kongevejen 243, DK-3070 Snekkersten, Denmark, e-mail: tlu@oticon,dk; 2003; 42;S49-S58.

(Continued)

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

Individual adjustment of a hearing apparatus, and in particular a hearing aid, is improved by testing the auditory sensory memory of a user of the hearing apparatus. At least one test result is obtained and the hearing apparatus is adjusted in dependence on the at least one test result. The test person must detect, perceive and be able to reproduce changes in a signal.

13 Claims, 3 Drawing Sheets

(56) References Cited

OTHER PUBLICATIONS

J. Acoust. Soc. Am., "Speech understanding and aging", Working Group on Speech Understanding and Aging, Committee on Hearing, Bioacoustics, and Biomechanics, Commission on Bahavioral and Social Sciences and Education, National Research Council, Washington, DC 20418; 83(3), Mar. 1988; Others; 1988.

Kartik, N. et al: "Sensory Memory and the Mismatch Negativity". All India Institute of Speech and Hearing, University ofMysore, Mysore, India; audiologyonline (online). in: http://www.audiologyonline.com/articles/pf_article_detail.asp?article_id=1403; Jul. 25, 2005.

* cited by examiner

METHOD OF ADJUSTING A HEARING APPARATUS WITH THE AID OF THE SENSORY MEMORY

CROSS-REFERENCE TO RELATED APPLICATION

This application claims the priority, under 35 U.S.C. §119, of German patent application DE 10 2012 203 349.1, filed Mar. 2, 2013; the prior application is herewith incorporated by reference in its entirety.

BACKGROUND OF THE INVENTION

Field of the Invention

The present invention relates to a method for adjusting a hearing apparatus. The present invention also relates to an adjustment mechanism for this purpose. A hearing apparatus is here taken to mean any device which can be worn in or on the ear and produces an auditory stimulus, in particular a hearing aid, a headset, headphones and the like.

Hearing aids are wearable hearing apparatuses that are used to support the hard of hearing. Different hearing aid designs, such as behind-the-ear hearing aids (BTE), hearing aids with an external receiver (RIC: receiver in the canal) and in-the-ear hearing aids (ITE), for example also concha hearing aids or completely-in-canal hearing aids (ITE, CIC) are provided in order to accommodate the numerous individual requirements. The hearing aids listed by way of example are worn on the outer ear or in the auditory canal. However, bone conduction hearing aids, implantable or vibrotactile hearing aids are also commercially available, moreover. In this case damaged hearing is either mechanically or electrically stimulated.

In principle hearing aids have as their fundamental components an input converter, an amplifier and an output converter. The input converter is usually a sound pick-up, for example a microphone and/or an electromagnetic receiver, for example an induction coil. The output converter is usually implemented as an electroacoustic converter, for example a miniature loudspeaker, or as an electromechanical converter, for example a bone conduction receiver. The amplifier is conventionally integrated in a signal processing unit. This basic construction is shown in FIG. 1 using the example of a behind-the-ear hearing aid. One or more microphone(s) 2 for receiving the sound from the environment are fitted in a hearing aid housing 1 for wearing behind the ear. A signal processing unit (SPU) 3, which is also integrated in the hearing aid housing 1, processes the microphone signals and amplifies them. The output signal of the signal processing unit 3 is transmitted to a loudspeaker or receiver 4 which outputs an acoustic signal. The sound is optionally transmitted via a sound tube, which is fixed to an otoplastic in the auditory canal, to the eardrum of the wearer of the aid. The energy supply to the hearing aid, and in particular that of the signal processing unit 3, takes place by way of a battery 5 likewise integrated in the hearing aid housing 1.

The auditory system of a person includes cochlear processing at the input side and extends through to higher-level processing in the auditory cortex. Hearing losses affect the auditory system in its entirety irrespective of the origin of the hearing defect. Hearing loss can therefore occur due to damage to the cochlea, auditory nerve or the cortical system. The success and gain of a hearing aid adjustment depends on the setting of the hearing aid according to the individual state of damage within the auditory system. Currently only cochlear dysfunctions are usually taken into consideration when adjusting hearing aids, however. Corresponding audiograms are recorded for this purpose. Auditory processes at a higher level are not taken into consideration, however, if an adjustment, and in particular an initial adjustment, is made.

A method for controlling the adjustment of a hearing aid is described in German published patent application DE 10 2009 032 238 A1. A test signal is produced in that case by means of a signal source and the perception of the test signal by the hearing aid wearer is evaluated. The test signal is a natural speech element or a speech element comparable to a natural one, which is spectrally filtered or chosen such that the spectrum of the test signal corresponds to the spectral range of at least one filter in the filter bank of the hearing aid.

Furthermore, patent application publication US 2010/0196861 A1 describes a method for operating a hearing aid on the basis of an estimate of an instantaneous cognitive load of a user. The cognitive load is estimated by way of an in situ measurement, by way of example on the basis of an EEG measurement.

SUMMARY OF THE INVENTION

It is accordingly an object of the invention to provide a method of adjusting a hearing device which overcomes the above-mentioned disadvantages of the heretofore-known devices and methods of this general type and which provides for the ability to better adjust a hearing aid to the individual requirements.

With the foregoing and other objects in view there is provided, in accordance with the invention, a method of adjusting (i.e., tuning) a hearing apparatus, the method which comprises:

testing an auditory sensory memory of a user of the hearing apparatus to thereby generate at least one test result; and adjusting the hearing apparatus in dependence on the at least one test result.

In other words, the objects of the invention are achieved by a method for adjusting a hearing apparatus by testing the auditory sensory memory of a user of the hearing apparatus. At least one test result is obtained and the hearing apparatus is adjusted as a function of the at least one test result. The expression "sensory memory" is an established term in the pertinent art and could best be interpreted as "perception memory."

Also provided according to the invention is an adjustment mechanism for adjusting a hearing apparatus, also referred to as tuning the hearing apparatus, comprising a test mechanism for testing the auditory sensory memory (perception memory) of a user of the hearing apparatus, wherein at least one test result is obtained. The hearing apparatus is adjusted by way of a tuning mechanism that adjusts the hearing apparatus in dependence on the at least one test result.

Advantageously, the auditory sensory memory (perception memory) is taken into consideration when adjusting a hearing apparatus. Changes in the pitch, loudness, tone, phase structure and in the sound duration in particular can thereby be taken into consideration when adjusting a hearing aid. Part of the auditory system which is systematically located between the input stage of the cochlea and the end stage of processing in the auditory cortex is thereby taken into consideration for the adjustment of a hearing aid. That is, the sensory memory is used for the adjustment.

Retentiveness with respect to an interaural time difference and/or level difference is preferably examined during testing. The sensitivity to changes in relation to phase and level can be examined thereby. A loss of this sensitivity can have an effect on intelligibility, localization ability and tone perception.

It is particularly advantageous if during testing a binaural first sound comprising two individual sounds (one for the left ear and one for the right ear) with a first interaural time difference or level difference and then a binaural second sound comprising two individual sounds with a second interaural time difference or level difference are presented to the user in a first step, in a subsequent second step the user supplies information about the time difference or level difference in the first sound and in the second sound from his sensory memory and in a following third step the test result is obtained from the information. In the process it is therefore registered whether or how easily the user can perceive a phase or level difference and then reproduce this perception in some form. To provide corresponding information on perception the user can make suitable gestures or press corresponding buttons by way of example.

In a development of the test at least one additional sound comprising two individual sounds with a third interaural time difference or level difference is presented to the user in a first step, in a second step the user then also supplies additional information about the time difference or level difference in the additional sound and in the third step the additional information is also taken into consideration for the test result. A chain of three, four or more signals or sounds is therefore presented to the user in each case here and he has to then press corresponding buttons by way of example three times, four times, etc. The first interaural time difference or level difference can match the second and/or third difference in this connection. In other words, any test patterns of the time differences or level differences can be chosen.

Before testing the auditory sensory memory or perception memory it is expedient to perform a discriminatory test as to whether the user can distinguish between two signals with different interaural time- and/or level differences at all. As a result it may in particular be established whether the input side (cochlea, etc.) of the auditory system is working.

A directionality and/or binaural signal processing of the hearing apparatus can be adjusted with the aid of the test result. The sensitivity of the hearing with respect to directionality and binaural processing is linked namely to the sensory memory in relation to the time differences and level differences.

The first and second steps of the test are preferably repeated several times with altered parameters (different first and second interaural time or level differences), and in the third step the test result is formed from the information from the user from all repetitions. A series of tests is performed thereby in relation to the sensory memory and the adjustment of the hearing aid or hearing apparatus is then made as a function of the entire test series.

Instead of the parameter "interaural time difference and/or level difference" the parameters "pitch," "phase," "tone" or "loudness" or even a combination of these parameters and a dynamic change in one or more of these parameters are tested. The sounds are monaural in this case, or each binaural sound has identical individual sounds for the left and right ears. This means that the individual test steps presented above are carried out with respect by way of example to the "pitch" or "phase" parameter. The perception memory or sensory memory can thereby be tested not only in relation to interaural time difference or level difference, but also in relation to changes in pitch, phase, tone or loudness, and optionally other parameters as well.

A frequency compression, sound balance, music program or feedback suppression of the hearing aid can be adjusted thereby if a memory test is performed with respect to the "pitch" parameter, i.e. the retentiveness in relation to a change in pitch.

If, on the other hand, a test is performed with respect to the "phase" parameter, by way of example a music program, directionality or sound balance can be adjusted with the test result since the phase change memory has an effect on this parameter of the hearing aid.

The test can be based on the "tone" parameter, moreover. In this case it is advantageous to adjust a sound balance, amplification, sound sharpness, HIFI feature, compression or frequency range of the hearing aid with test result obtained.

The test can also be based on the "loudness" parameter. In this case the aim is to adjust a compression or amplification of the hearing aid with the aid of the test result obtained.

Other features which are considered as characteristic for the invention are set forth in the appended claims.

Although the invention is illustrated and described herein as embodied in a method for adjusting a hearing apparatus with the aid of the sensory memory, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
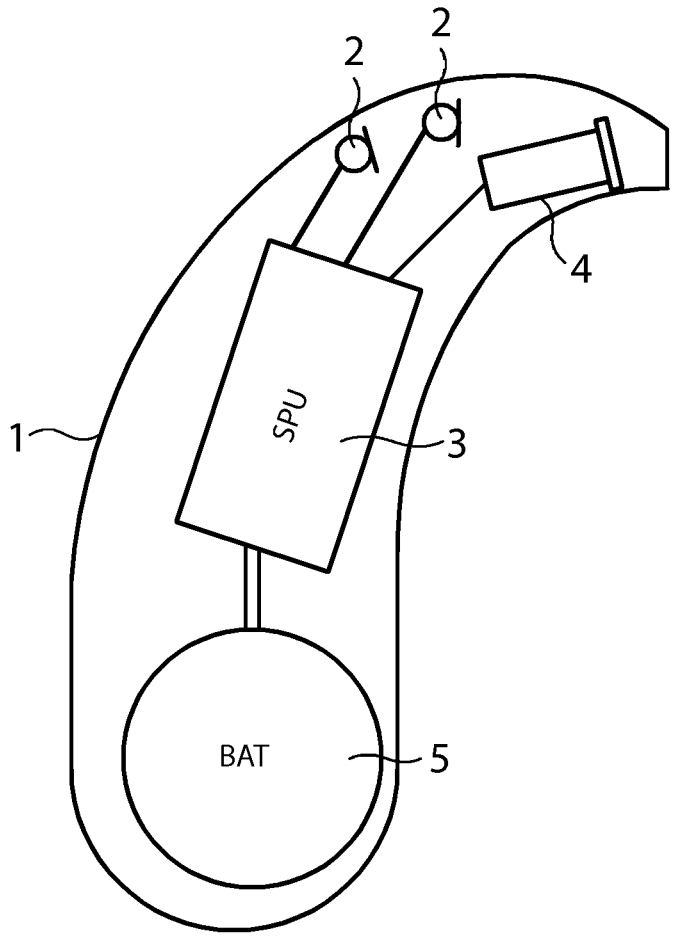
FIG 1 PRIOR ART
FIG. 1 is a schematic view of a hearing aid according to the prior art.

The exemplary embodiments described in more detail below are preferred embodiments of the present invention.

A fundamental concept underlying the present invention is that the auditory system is substantially divided into three. The ear is located at the entrance and signal processing in the auditory cortex is found at the end. The sensory memory (i.e., perception memory) is located therebetween. In graphic terms, the sensory memory could be allocated to the auditory nerve.

The functionality of the first part of the auditory system, i.e. of the ear, can be determined by psychoacoustic tests. What is known as a "discriminatory test" can be performed by way of example in which two sounds are played back one after the other, and these differ from each other with respect to one parameter (for example pitch in the case of binaural signals or time difference in the case of binaural signals).

The threshold at which the test person can still just about perceive the difference in the two sounds (JND=Just Noticeable Difference) can then be determined. Such tests of the ear can then be used to adjust the hearing aid to the test person.

In the 1970s it was found (T. Lunner) that the auditory cortex converts not only the signals of the ear into corresponding perceptions but that the processes of the auditory cortex themselves affect the perceptions. It has therefore been found that the load on the auditory cortex has an effect on sensitivity. These recognitions, as illustrated in the above-mentioned document US 2010/0196861 A1, are used to adjust hearing aids.

The present invention is accordingly based on the idea that the sensory memory or perception memory affects perception even before signal processing in the auditory cortex. This must also be taken into consideration for the adjustment of a hearing apparatus or hearing aid.

The problem of the sensitivity of a person in relation to a memory of changes in sound amplitudes, and the problem of the ability to process such changes can only be analyzed by way of feedback from the respective test person if the test person has worn the hearing aid for a relatively long time. Individual visits and consultations with an acoustician have previously been necessary for this purpose. Studies involving surveys in different age groups have also been carried out in relation to general learning about cortical signal processing. However, there has not previously been any opportunity for the acoustician to directly estimate the individual sensory memory or perception memory in relation to interaural time difference, interaural level difference and changes in relation to pitch, phase, tone or loudness.

A test method is therefore proposed here which should enable such an estimate in order to be able to adjust a hearing aid in accordance with the test results or estimate. The test can be implemented by way of software and hardware.

In a preferred embodiment the test for the adjustment method comprises two parts: what is known as a "discriminatory test" followed by what is known as a "memory test". This two-part test allows conclusions to be drawn about the origin of the hearing loss. The discriminatory test permits statements about the functionality by way of example of the cochlea, while the memory test provides statements about the sensory memory. The results of the two tests allow a prediction of the success of different hearing aid settings and adjustments.

During the discriminatory test it is firstly established whether the test person can distinguish between two different signals at all. The aim is not to determine the JND (Just Noticeable Difference) here. Instead the aim is to find signals which the test person can definitely distinguish. These signals which can definitely be distinguished are then the basis for the subsequent memory test. After hearing two different signals the test person must actuate one of two buttons respectively, of which one stands for "identical" and the other stands for "different". The user can optionally also provide this information by way of gestures or verbally.

The memory test is used to determine whether and optionally also how easily a test person can notice changes in a signal. The memory test can be based on the two-AFC method (Alternative Forced Choice) or on a different method, for example Serial Order Recall or the three-AFC Oddity Task test. These tests are described in more detail below. The success of these tests depends greatly on the specific choice of parameters, as is illustrated in the examples shown below.

An important additional aspect of the test can lie in the fact that the beginning of each test phase is changed (what is known as "roving"). By way of example the interaural time difference is changed with each test run. Furthermore, as a rule it is also advantageous for the test if the test person does not receive any feedback about his information from the investigator. Learning is avoided thereby.

The memory test then provides test results which can be used for hearing aid adjustment or setting a hearing apparatus. In particular the memory test provides two different diagnoses in relation to sensitivity to changes (i.e. by way of the reception memory). On the one hand the range of the sensory memory can be determined, i.e. the number of different sounds which the test person can perceive. Using the total number of sounds/elements in a sound pattern/element pattern, which the test person can perceive to a greater or lesser extent, conclusions can be drawn about the capacity of the sensory memory by way of example for localization.

On the other hand, the memory test provides a statement on the processing speed or capacity of the sensory memory. Using the ease with which a certain number of elements can be perceived, conclusions can be drawn about the ability of auditory processing for a certain task (for example localization). The ease with which the test person can perceive the different signals results from the number of errors during the test. Statements on the ease can also be obtained by way of the overall speed of the test.

The test results provide statements about the prospect as to what extent a test person can benefit from different hearing aid features. Such features are by way of example the choice of directionality, parameterization of the directionality feature and all features in relation to binaural coupling and its parameterization (for example binaural noise suppression).

An exemplary embodiment of a memory test in relation to the interaural time difference or interaural level difference will be illustrated below. The test is performed binaurally and can take place by changing the interaural time difference (ITD) or the interaural level difference (ILD). The ITD will be changed below.

Figure 2:
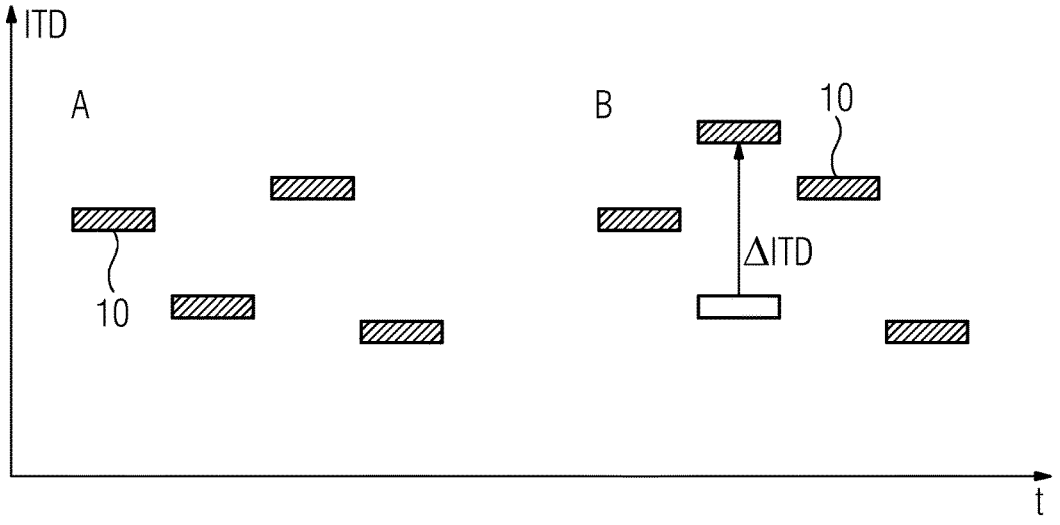
FIG. 2 is a graph showing a sound example for a discriminatory test.

The test is performed by a sequence of two binaural signals according to FIG. 2: a first signal A and a second signal B. Such a sequence of signals can also be called a chain. In the example from FIG. 2 each binaural signal A, B has four varying binaural sounds 10 respectively. In this connection a binaural sound means an individual sound for the left ear and an individual sound for the right ear, wherein both individual sounds differ by the interaural time or level difference. The test person therefore listens to the chain A-B and then has to distinguish whether signal A is identical to signal B or is different. The test person always uses the same interface to provide the corresponding information. By way of example, as already indicated above, he always uses the two buttons "identical" and "different" to provide his information.

In the example of FIG. 2 the first, third and fourth sounds in the two signals A and B are identical. The second sound on the other hand is shifted upwards by δ ITD in signal B compared with signal A. If the test person registers the difference in the two signals A, B and can perceive it he presses the "different" key.

FIG. 2 shows the test with N=4 sounds. The test preferably begins, however, at a first level where N=1 and then gradually increases upwards by one step, by way of example to N=4 or more.

If the test starts at level one, then this substantially corresponds to a discriminatory test. For N=1 the binaural first signal A consists of a basic frequency and its first n harmonics (hereinafter called sound 10). The first signal has an ITD of zero here. The second binaural signal B consists of the same sound as the first binaural signal A, but ITD=0.25 ms.

If the test person's response is incorrect (if he has pressed the "identical" button), the next chain consists of the binaural first signal A followed by the binaural second signal B with the same sound, but the ITD is increased or decreased (for example by a multiple of the original ITD). The procedure of the change in the difference between the first and the second signals is repeated in successive chains until the test person no longer recognizes that the first signal A and the second signal B are not different anymore. The identical chains are repeated several times and the test person must not have recognized that the two signals are different in a predefined number of repetitions. This predefined number of repetitions can be by way of example 1, 3, 5 or 10. The number is established before the test. As a result thereof an ITD between two sounds is established which the test person requires in order to reliably recognize that the two sounds come from different directions (and this results from the time difference).

The level of the tests is then increased to N=2, i.e. the number of sounds in a signal is increased to two. The actual memory test begins therewith. The first signal A accordingly consists of two sounds of the same type (basic frequency and several harmonics). The two sounds are presented in rapid succession: firstly the binaural original sound followed by the identical binaural original sound (identical predefined ITD, i.e. identical input direction), or the original sound is followed by a sound shifted by a multiple of the predefined ITD (such as with N=1).

The second signal consists either of an exact repetition of the first signal A or of a change in the ITD (direction) of one of the sounds of the first signal A. Once the test person has heard the chain he has to repeat the sequence of sounds or provide corresponding information by pressing by way of example the "identical" button or the "different" button.

The test person must thus provide the correct answer for a predefined number of chains before the test jumps to the next level. The increase in the number of elements or sounds for a signal is variable. By way of example the increase may be one or three sounds, for example from two to three or from two to five, depending on which degree of difficulty is desired.

At level 3 (N=3) the first signal consists by way of example of three binaural sounds of the same type but with different ITDs. These may be randomly chosen, wherein preferably at least the ITD which was established at level N=one is retained. The second signal B is either the exact repetition of the first signal A or an altered first signal. The test person responds again by pressing the corresponding keys. This is also repeated for a certain number of chains. The test then jumps to the next level, etc.

The test stops at a level if the test person is no longer capable of perceiving a change (or non-change) between the first signal and the second signal for a fixed number of chains.

To avoid a learning effect the start sound of the first signal is randomly changed (roving) in each chain. The position of the change in a signal should also be changed. This is due to the phenomenon of informational masking. The task of recognizing a change in a melodic pattern can be made more or less difficult thereby. This can occur by way of example by increasing the number of elements or sounds in a signal (melodic pattern). It may also occur, however, by changing the pattern (precedence and novelty effects: the changes in either the first or final element are the easiest to recognize, etc.). The test person can choose whether he wishes to have one change or several changes in the melodic pattern (signal) and with respect to which elements. Preferably only one element is changed and, more precisely, the final or penultimate element. If the test needs to be more difficult the change in position can occur within a level or even within a chain.

Figure 3:
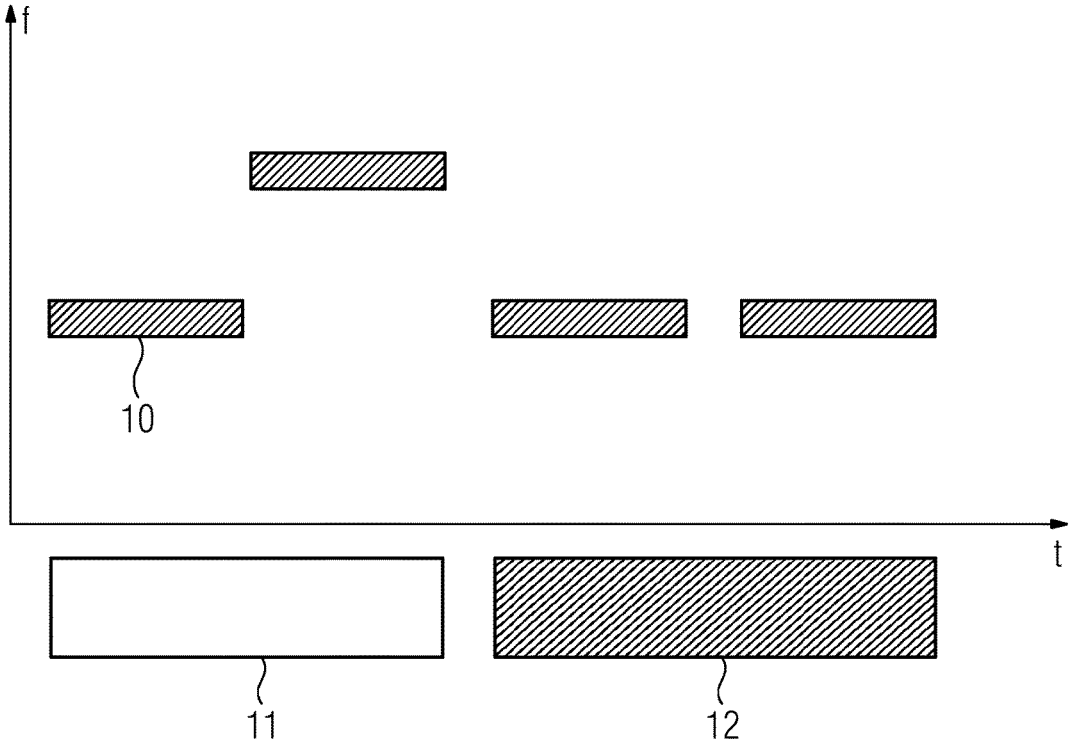
FIG. 3 is a graph showing an example of the serial playback.

FIG. 3 symbolically reproduces a second type of memory test. This test is based on motor reproduction and can also be called "serial recall." A signal having a plurality of sounds 10 is also reproduced here. Depending on the purpose of the test, the sounds, as above, consist by way of example of binaural sounds with different ITD or ILD. However, different pitches may also be tested, so, as in the example of FIG. 3, the frequency f changes between monaural sounds. In each case the test person must press the two buttons 11, 12 corresponding to the sequence of sounds. In the present example he firstly needs to press button 11, then button 12 and then button 11 again twice. He has consequently provided subjective information about the sequence of sounds he has heard. The sensory memory can also be checked in this way.

Figure 4:
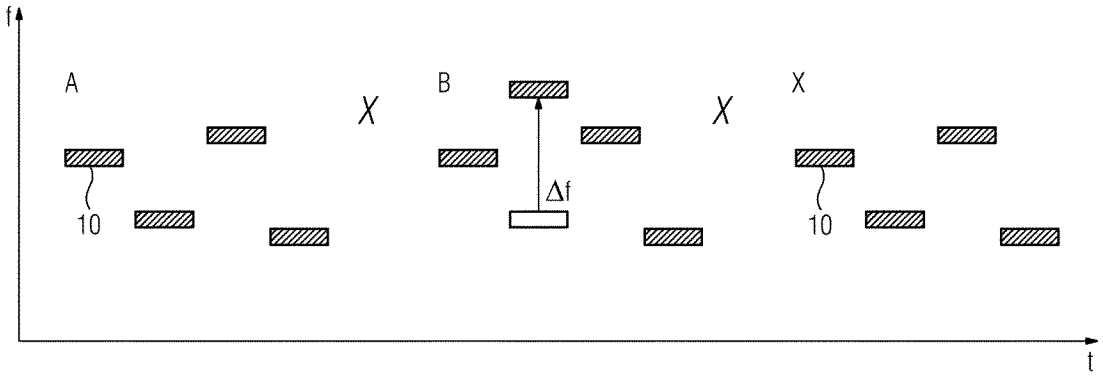
FIG. 4 is a graph showing an example for identifying a different signal from three signals.

A further possibility of the memory test consists according to FIG. 4 in that three signals A, B and X are presented one after the other, with each signal having a plurality of sounds 10 (in the present case four sounds per signal). Two of the signals are identical and one can be different from the other signals (different pitches again in this case). The test person has to recognize this different signal and provide appropriate information in this regard. In the example of FIG. 4 the second sound 10 has been shifted upwards by $\Delta f$. In other words, its pitch has been increased. This can analogously also be transferred to the interaural level difference or the interaural time difference by presenting the sounds binaurally and the second sound being given a different interaural level or time difference. A different parameter, by way of example the tone, sound sharpness, loudness and the like may similarly be changed in the case of one of the sounds. The applicability to parameters other than the frequency f illustrated in each case may also be transferred to the test according to FIG. 3. Conversely, in the case of the test in FIG. 2 a different parameter from the ITD, such as the pitch, tone etc., may also be changed.

A further parameter which is likewise of interest in relation to the sensory memory is the change in loudness. The loss of sensitivity to the change in loudness can have an adverse effect on intelligibility (vocal contours), on the individual dynamic range and consequently also on the choice of compression parameters and the amplification of the hearing aid. Conversely this means that the results of a memory test in relation to changes in loudness can affect different setting parameters of the hearing aid. These include in particular the compression strength as a function of the dynamic range (perceived variations in loudness), choice of compression time constants (necessity of a certain flexibility with respect to variations in loudness), the loudness control, learning of loudness features and the MPO adjustment (Maximum Pressure Out).

The memory test with the plurality of levels described above in connection with the interaural time difference and level difference can also be used here for changes in loudness. The test includes a comparison with an increasing number of sounds per signal, wherein the test begins with a single sound per signal (melodic pattern). The second signal then has by way of example a sound which is louder or quieter by 3 dB than the sound of the first signal. The test person has to (be able to) recognize this change. If this is ensured the actual memory test in relation to the changes in loudness can be performed analogously to the memory test in relation to the interaural time difference and level difference or pitches in the levels N=2, N=3, etc.

Furthermore, the memory test can also be used in relation to the perception of changes in tone. The loss of sensitivity with respect to tone also has an effect on intelligibility (vocal formants), perception of higher frequencies and consequently on the choice of amplification of the hearing aid. The following hearing aid parameters are affected therefore: sound balance control, amplification at higher frequencies (sensitivity to sound sharpness), learning of sound balance features, sound sharpness, HIFI features, frequency compression, frequency range of the hearing aid and constant amplification. During the test the tone is then changed instead of the interaural time difference or interaural level difference. The test person has to remember the change in tone if he is providing his information from memory.

Furthermore, the memory test can be used to examine sensory memory with respect to changes in phase. Sounds are then presented during the test in which one or more phases have been changed. The loss of sensory memory in this regard also affects speech intelligibility, localization ability and tone perception. Test results from this test can therefore be used to adjust the hearing aid with respect to the following features: music program settings, intelligibility, directionality and sound balance control, including its learning process.

The above test can also be used to analyze the sensory memory with respect to changes in the sound. An overtone is added to the basic frequency and existing overtones in this connection by way of example, or one of the existing overtones is removed. The loss in this sensitivity also has an effect on the intelligibility (vocal contours), music perception and overall frequency formation of the hearing aid. The test results can therefore be used to adjust or set the following features on the hearing aid: frequency compression (flexibility in relation to changes in sound which are needed), sound balance (distinguishing of sounds which are needed), choice of music program (yes or no), parameterization of feedback suppression (sound shift sensitivity) and constant amplification.

All of the tests mentioned above can also be performed in combination with each other and be cascaded into each other timewise (i.e., temporally).

The invention claimed is:

1. A method of adjusting a hearing apparatus of a user, the method which comprises:

testing an auditory sensory memory of the user of the hearing apparatus to generate at least one test result, the testing including:

in a first step, presenting to the user a first binaural sound comprising two individual sounds, one sound for each ear, with a first interaural time difference or first interaural level difference between the two individual sounds;

then, presenting a second binaural sound comprising two individual sounds, one sound for each ear, with a second interaural time difference or a second interaural level difference between the two individual sounds; and in a subsequent step, receiving information supplied by the user from the user's auditory sensory memory after the first step about the time difference or level difference in the first binaural sound and in the second binaural sound; and adjusting the hearing apparatus in dependence on the at least one test result.

2. The method according to claim 1, wherein the testing step further comprises:

in a second step subsequent to the first step, causing the user to supply information about the time difference or level difference in the first sound and in the second sound from the user's sensory memory; and in a following third step, obtaining the test result from the information.

3. The method according to claim 2, which further comprises:

in the first step, presenting to the user at least one additional sound comprising two individual sounds with a third interaural time difference or level difference;

in the second step, enabling the user to also supply additional information about the time difference or level difference in the additional sound; and in the third step, taking the additional information into consideration for the test result.

4. The method according to claim 3, which comprises, prior to the first step, performing a discriminatory test as to whether the user can distinguish two sounds with different interaural time differences and/or level differences at all.

5. The method according to claim 2, which comprises repeating the first and second steps a plurality of times with respectively changed parameters, and forming the test result in the third step from the information provided by the user from all repetitions.

6. The method according to claim 1, which comprises, prior to testing the auditory sensory memory, performing a discriminatory test as to whether the user can distinguish two sounds with different interaural time differences and/or level differences at all.

7. The method according to claim 1, which comprises adjusting one or both of a directionality and a binaural signal processing of the hearing apparatus on a basis of the test result.

8. The method according to claim 1, wherein the testing step includes examining a retentiveness with respect to at least one parameter selected from the group consisting of pitch, phase, tone, loudness, and a combination thereof, and a dynamic change in one or more of the parameters so tested, and wherein the sounds are monaural or each binaural sound has identical individual sounds for the left and right ears of the user.

9. The method according to claim 8, which comprises adjusting a frequency compression, a sound balance, a music program, or a feedback suppression with the aid of a test result concerning the pitch parameter.

10. The method according to claim 8, which comprises adjusting a music program, a directionality or a sound balance with the aid of a test result concerning the phase parameter.

11. The method according to claim 8, which comprises adjusting a sound balance, an amplification, a sound sharpness, a HiFi feature, a compression or a frequency range with the aid of a test result concerning the tone parameter.

12. The method according to claim 8, which comprises adjusting a compression or an amplification with the aid of a test result concerning the loudness parameter.

13. An adjustment mechanism for adjusting a hearing apparatus, comprising:

a test device configured for testing an auditory sensory memory of a user of the hearing apparatus and for obtaining at least one test result, the test device configured to:

in a first step, present to the user a first binaural sound comprising two individual sounds, one sound for each ear, with a first interaural time difference or first interaural level difference between the two individual sounds;

then, present a second binaural sound comprising two individual sounds, one sound for each ear, with a second interaural time difference or a second interaural level difference between the two individual sounds; and in a subsequent step, receive information supplied by the user from the user's auditory sensory memory after the first step about the time difference or level difference in the first binaural sound and in the second binaural sound; and an adjusting mechanism for adjusting the hearing apparatus in dependence on the at least one test result.

* * * * *